United States Patent [19]

Tamura

[11] Patent Number: 4,546,822

[45] Date of Patent: Oct. 15, 1985

[54] HEAT EXCHANGER WITH ADHESIVE SEALS

[75] Inventor: Masami Tamura, Toyota, Japan

[73] Assignee: Nippondenso Co., Ltd., Kariya, Japan

[21] Appl. No.: 546,388

[22] Filed: Oct. 28, 1983

[30] Foreign Application Priority Data

Nov. 1, 1982 [JP] Japan ..... 57-192835
Jul. 22, 1983 [JP] Japan ..... 58-134946

[51] Int. Cl.[4] ..... F28F 9/16

[52] U.S. Cl. ..... 165/149; 165/79; 165/151; 165/173; 165/906

[58] Field of Search ..... 165/79, 173, 175, 178, 165/149, 151, DIG. 9

[56] References Cited

U.S. PATENT DOCUMENTS 3,633,660 1/1972 Young ..... 165/79 X
3,993,126 11/1976 Taylor ..... 165/173
4,295,522 10/1981 Frei ..... 165/79
4,305,459 12/1981 Nonnenmann et al. ..... 165/173
4,484,621 11/1984 Kuchelmeister ..... 165/149 X

FOREIGN PATENT DOCUMENTS 214794 12/1983 Japan ..... 165/DIG. 8

*Primary Examiner*—Sheldon J. Richter
*Attorney, Agent, or Firm*—Cushman, Darby & Cushman

[57] ABSTRACT

A solderless type automotive engine radiator has upper and lower tanks and a heat exchanger core connected at the upper and lower ends to the tanks through upper and lower header plates. The core is formed by tubes and fins secured to the tubes without soldering. The upper and lower ends of the tubes are in gripping engagement with inner peripheral surfaces of holes formed in the header plates. Layers of adhesive are formed on the surfaces of the header plates adjacent to the core to form liquid-tight seals between the header plates and the tubes. The adhesive layers and the fins are arranged such that at least the fin nearest to an adjacent adhesive layer is either in face-to-face engagement with the adjacent adhesive layer or embedded in the adjacent adhesive layer to strengthen the adhesive layer and protect the same against foreign materials such as water and dirt whereby the durability of the seals is improved.

14 Claims, 7 Drawing Figures

HEAT EXCHANGER WITH ADHESIVE SEALS

FIELD OF THE INVENTION

The present invention relates to a heat exchanger usable, for example, as an automotive engine radiator or as a heater core of an automotive air conditioner. More particularly, the present invention is concerned with a heat exchanger comprising a tank for momentarily storing a heat-transfer medium, said tank having a peripheral edge defining an opening, a header plate formed therein with a plurality of holes and sealingly secured to said peripheral edge of said tank to close said opening, a plurality of tubes each mechanically connected to one of said holes in said header plate so that said medium can flow through said tubes into and from said tank, a row of a plurality of fins disposed in heat-exchanging relationship to said tubes and extending substantially parallel to said header plate, and a layer of adhesive disposed on the surface of said header plate adjacent to said row of fins and forming a seal between said header plate and said tubes.

SUMMARY OF THE INVENTION

The present invention has its object to provide an improved heat exchanger of the class specified above in which that portion of each of the tubes which extends between the header plate and an adjacent fin is reliably protected by the layer of the adhesive against corrosion and the adhesive layer itself is mechanically strengthened to provide an improved durability and a reliable sealing performance.

To achieve this object, the present invention provides a heat exchanger of the class specified above in which the layer of the adhesive and the row of the fins are arranged such that at least the fin which is nearest to the header plate is in engagement with the adhesive layer.

This arrangement provides advantages that the portion of each tube extending between the header plate and the adjacent fin is reliably protected by the adhesive layer against corrosion and that the adhesive layer itself is mechanically supported not only by the header plate but also by the adjacent fin to provide a reliable liquid-tight seal between the header plate and the tubes for a prolonged period of time.

The present invention has another object to provide an automotive engine radiator which utilizes the heat exchanger structure discussed above.

The above and other objects, features and advantages of the present invention will be made more apparent by the following description with reference to the accompanying drawings.

DESCRIPTION OF THE PRIOR ART

Figure 1:
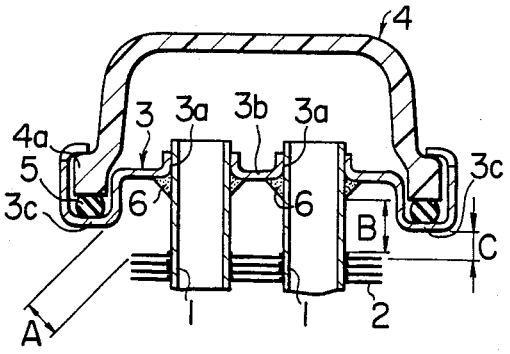
FIG. 1 PRIOR ART
FIGS. 1 and 2 are fragmentary vertical sectional views of examples of prior art solderless heat exchangers.
Figure 2:
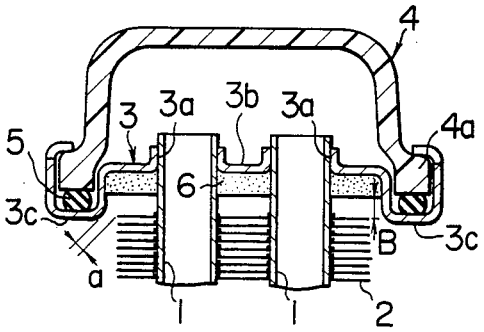
FIG. 2 PRIOR ART

With reference to FIGS. 1 and 2, each of the prior art solderless heat exchangers has a core formed by a plurality of parallel tubes 1 and a row of plate fins 2 disposed in heat-exchanging relationship to the tubes 1. Each tube 1 has an exposed end extending beyond the outermost plate fin 2. A header plate 3 which is sealingly secured to an open end of a tank 4 for momentarily storing a heat-transfer medium, such as engine cooling water, is formed with a plurality of holes 3*a* into which the exposed ends of the tubes 1 are inserted and radially outwardly expanded into engagement with the inner peripheral edges of the holes 3*a* so that the exposed ends of the tubes 1 are mechanically connected to the header plate 3. The header plate 3 has a central or inner zone 3*b* which is depressed partly into the tank 4 and in which the holes 3*a* are formed. The outer peripheral zone 3*c* of the header plate 3 is generally U-shaped in section. The outer arm of the "U" is bent onto a flange-like outer periphery 4*a* of the tank 4 to mechanically secure the header plate 3 to the tank 4. An O-ring 5 is interposed between the header plate 3 and the tank 4 to provide a seal therebetween.

In the example of the prior art shown in FIG. 1, an annular deposit of an adhesive 6 is formed at the connection between the exposed end of each tube 1 and the associated hole 3*a* to provide a seal therebetween. In the example of the prior art shown in FIG. 2, a layer of the adhesive 6 is formed in the recess formed by the inwardly depressed inner zone 3*b* of the header plate 3. The adhesive layer 6 surrounds a part of the length of each of the exposed ends of the tubes 1 to provide a seal between the tubes and the header plate 3.

The other end of each of the tubes is similarly mechanically and sealingly connected to another header plate (not shown) which in turn is sealingly secured to another tank (not shown) to complete a heat exchanger.

The prior art heat exchangers discussed above can conveniently be assembled by mechanically connecting or securing steps such as tube expanding step and caulking or bending step and without any soldering step which is not desirable in the view point of working environment. However, the prior art structures shown in FIGS. 1 and 2 have following problems:

In the manufacture of each of the prior art heat exchangers, the fins 2 are first assembled with the tubes 1 to form a core which is then assembled with the header plate 3. Thereafter, an adhesive is introduced into the depressed central or inner zone 3*b* of the header plate 3 to form the annular deposit of adhesive 6 or the layer of adhesive 6. In the structure shown in FIG. 1, it requires complicated and difficult steps to form the annular deposits of adhesive 6 only at the connections between the header plate 3 and the tubes 1. In order to provide an access to the adhesive deposits 6, the outermost fin 1 must be spaced a distance A from the nearest part of the header plate 3, i.e., from the inner peripheral edge of the bottom of the U-shaped outer peripheral zone 3*c* of the header plate 3. This will mean that the uppermost fin 2 must be spaced a distance C from the bottom of the U-shaped outer peripheral zone 3*c* in the axial direction of the tubes 1. Accordingly, the exposed ends of tubes 1 are covered with the annular adhesive deposits 6 only at their parts immediately adjacent to the header plate 3. In other words, the exposed tube ends are not covered with the annular adhesive deposits 6 at their portions corresponding to a distance B between the uppermost fin 2 and the header plate 3. The uncovered or exposed tube portions suffer from corrosion. In addition, because no fin is provided on the tubes 2 for the distance C, the heat exchanger has a correspondingly decreased heat-exchanging efficiency.

In the structure shown in FIG. 2, the layer of adhesive 6 can be formed relatively easily. The only requisite for the adhesive application step is to provide a small distance a which is smaller than the distance A in FIG. 1 and which is large enough to provide an access to an adhesive injection tube (not shown). The adhesive may be injected until the thickness of the adhesive layer 6 is increased to reach the uppermost fin 2. However, the uppermost fin 2 is not necessarily planar and may, in some cases, be twisted or deformed in wave-like shape. It is, therefore, difficult to completely cover the exposed end portions of the tubes with the adhesive layer 6. A second problem which the FIG. 2 prior art structure has is the fact that the adhesive layer 6 has a large area of contact with the header plate 3 and the tubes 1 and is subjected to a large shrinkage stress when the adhesive is cured. The shrinkage stress tends to peel the adhesive layer 6 from the contacting surfaces of the header plate 3 and the tubes 1. In addition, the adhesive layer 6 is subjected to repeated mechanical and thermal shocks and attacked by foreign materials such as water and dirt which in combination adversely affect the material of the adhesive layer 6, with a result that small gaps are formed between the adhesive layer 6 and the tubes 1 to cause leakage at the connections between the header plate 3 and the tubes 1.

DESCRIPTION OF PREFERRED EMBODIMENTS

Figure 3:
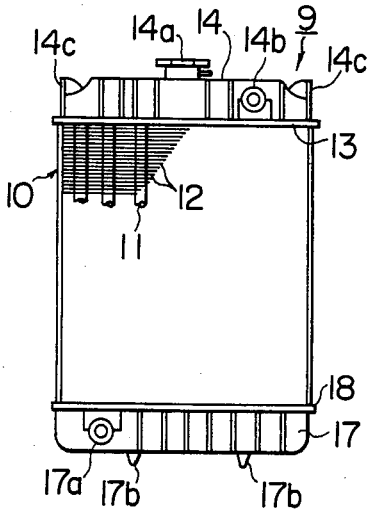
FIG. 3 is a front view of an automotive engine radiator embodying the present invention.

Referring to FIG. 3, an automotive engine radiator 9 of down-flow type comprises upper and lower tanks 14 and 17 for momentarily storing heat-transfer medium such as coolant, a core 10 formed by a plurality of substantially parallel tubes 11 and plate fins 12 mechanically secured to the tubes in heat-conductive relationship to the tubes, and upper and lower header plates 13 and 18 through which the upper and lower ends of the core 10 are respectively connected to the upper and lower tanks 14 and 17 in fluid-flow communication. The upper and lower tanks are made of a molded plastic material such as glass fiber-reinforced nylon. The upper tank 14 is provided with a liquid pouring port 14*a*, a liquid inlet 14*b* and a pair of brackets 14*c* for mounting the radiator 9 on a body of an associated car. The lower tank 17 is provided with an liquid outlet 17*a* and a pair of legs 17*b* used to mount the radiator 9 on the car body.

Figure 4:
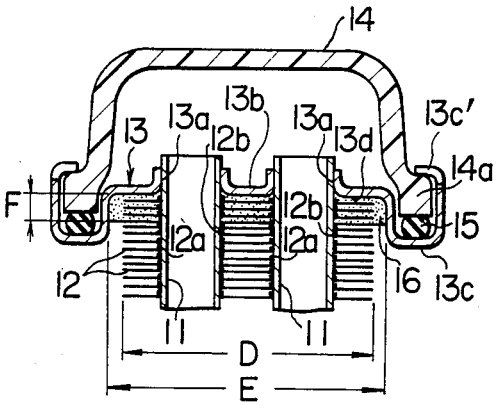
FIG. 4 is an enlarged fragmentary vertical sectional view of the radiator shown in FIG. 3.

Referring to FIG. 4, the tubes 11 are made of a light metal having a good heat-conductivity, such as aluminium or aluminium-manganese based alloy, and have substantially circular cross-sections which, however, may alternatively be oval. The plate fins 12 are made of aluminium. Each of the plate fins 12 is formed therein with a plurality of holes 12*a* which are equal in number to the tubes 11. Before the tubes and the fins are assembled into the core 10, each of the holes 12*a* in the fins 12 has an inner diameter which is greater than the tube outer diameter by from 0.2 to 0.4 mm to assure that the tubes 11 can easily be inserted into the holes 12*a*. A collar 12*b* is formed integrally with the inner peripheral edge of each of the holes 12*a* and has an axial dimension of about 2 mm. When the tubes 11 and the fins 12 are assembled into the core 10, the collars 12*b* of respective fins 12 surround the outer peripheral surfaces of the tubes 11 except for the end portions thereof and are in heat-conductive engagement with the tubes. Each fin 12, moreover, is formed thereon with louver vanes (not shown) to provide an improved heat exchange efficiency. The surfaces of the tubes 11 and the plate fins 12 are preferably clad with layers of a material which includes Zn or Mn and has a sacrificial corrosion effect.

The header plates 13 and 18 are preferably made of an aluminium-magnesium based alloy having rigidity and mechanical strength greater than those of the metal of the tubes 11. The lower header plate 17 is substantially identical in structure to the upper header plate 13. Thus, only the upper header plate 13 is shown in FIG. 4.

With reference to FIG. 4, the header plate 13 has an inner or central zone 13*b* which is formed with holes 13*a* defined by annular collars upstanding from and integral with the header plate 13. The holes 13*a* are equal in number to the tubes 11. Before the tubes 11 are inserted into the holes 13*a*, the inner diameters of the holes 13*a* are greater than those of the tubes, but after the tubes are inserted into the holes 13*a*, the tubes are expanded radially outwardly into metal-to-metal engagement with the inner peripheral edges or surfaces of holes 13*a*. The inner or central zone 13*b* of the header plate 13 is integral with an outer peripheral zone 13*c* which is generally U-shaped in section to define a peripheral groove in which an O-ring 15 is received. The tank 14 has a flanged open end 14*a* defining an opening and having an end face which is in sealing engagement with the O-ring 15. The outer arm of the U-shaped section of the outer peripheral zone 13*c* of the header plate 13 has integral fingers 13*c*' which are bent over a shoulder provided by the flanged end 14*a* of the tank 14 to mechanically and sealingly connect the tank to the header plate 13. The U-shaped outer peripheral zone 13*c* of the header plate 13 has its bottom offset downwardly from the central zone 13*b* of the header plate 13 so that the central zone 13*b* is depressed into the tank 14 with respect to the outer peripheral zone 13*c* of the header plate 13. Thus, the U-shaped outer peripheral zone 13*c* and the central zone 13*b* cooperate to define a downwardly directed recess 13*d* having a substantially planar bottom.

Unlike the prior art structures shown in FIGS. 1 and 2, the heat exchanger 9 is constructed and arranged such that the plate fins 12 are so arranged on the tubes as to be disposed also in the recess 13*d* defined by the central zone 13*b* and outer peripheral zone 13*c* of the header plate 13. In other words, the uppermost fin 12 is disposed immediately below the undersurface of the central zone 13*b* of the header plate 13.

A substantial part F of the depth of the recess 13*d* is filled with a layer 16 of a thermo-setting, epoxy resin-based adhesive, so that a plurality of plate fins 12 are embedded in the adhesive layer 16 to strongly grip and support the adhesive layer. The adhesive layer 16 is in intimate sealing contact with the bottom and inner peripheral surface of the recess 13*d* and with a part of the length of each tube 11 extending in the recess.

The lower tank 17 and the header plate 18 are substantially identical in structure to the upper tank 14 and the header plate 13. The lower tank 17 is mechanically and sealingly connected to the lower header plate 18 as in the case of the connection between the upper tank 14 and the upper header plate 13. The tubes 11 are also mechanically connected to the lower header plate 18 as in the case of the connection between the tubes and the upper header plate 13. Another layer of adhesive (not shown) is also provided to seal the connections between the tubes 11 and the lower header plate 18. The structural details of the connections between the lower tank 17 and the lower header plate 18, between the tubes 11 and the lower header plate and between the other adhesive layer, the lower header plate and the tubes will be apparent to those in the art from the illustration in FIG. 4 and the above description with reference thereto.

The steps of assembling the heat exchanger 9 will be described hereunder. First, a predetermined number of plate fins 12 are prepared each of which has the integral collar 12*b* around the hole 12*a* and a plurality of louver vanes (not shown) formed between the collor 12*b* and the peripheral edge of the plate fin. The predetermined number of the plate fins 12 thus prepared is equal to the number of plate fins required to form one heat exchanger of the prior art plus an additional number of fins (2 to 10 fins) which are to be embedded in a layer of adhesive to be formed in an adhesive layer forming step to be described later. Each of the plate fins 12 has a width D which is about 6 mm smaller than the width E of the depressed central section 13*b* of the header plate 13.

The tubes 11 are then inserted into the holes 12*a* in the plate fins 12 so that a row or stack of the plate fins 12 is formed around the tubes 11. Thereafter, two header plates 13 and 18 are placed over the outermost plate fins 12 of the stack so that tubes 11 extend through the holes 13*a* in the header plates.

Thereafter, tube expansion devices (not shown) are inserted into the tubes 11 and are operated to expand the tubes radially outwardly into metal-to-metal gripping engagement with the plate fins 12 and the header plates 13 and 18. More specifically, the tubes 11 are expanded so that the outer surfaces of the tubes are simultaneously brought into pressure-contact with the inner peripheral surfaces of the collars 12*b* of the plate fins 12 and the collars around the holes 13*a* in the header plates 13 and 18 whereby these collars now surround the tubes 11.

Then, the surfaces of the tubes 11, the plate fins 12 and the header plates 13 and 18 are washed by an alkaline washing agent the major component of which is sodium silicate so that dust and oil are removed therefrom. The alkaline washing agent is then washed away from the tubes, the plate fins and the header plates by water at a normal temperature. The members are then dried completely.

An O-ring 15 is placed in the peripheral groove defined in the U-shaped outer peripheral zone 13*c* of the header plate 13. The tank 14 is then placed over the header plate 13 so that the flanged end 14*a* of the tank 14 rests on the O-ring 15. The fingers 13*c'* extending from the outer arm of the U of the U-shaped outer peripheral zone 13*c* of the header plate 13 are then bent inwardly onto a shoulder provided by the flanged end 14*a* of the tank 14 to urge the end face of the tank end 14*a* into sealing engagement with the O-ring 15 and simultaneously urge the O-ring into sealing engagement with the header plate 13. The lower tank 17 is similarly sealingly secured to the lower header plate 18 to form a heat exchanger assembly.

Finally, water-tight seals are formed between the tubes 11 and the upper header plate 13 and between the tubes and the lower header plate 18. The seals are made by the following steps: First, the heat exchanger assembly is pre-heated to about 60° C. An adhesive pouring tube (not shown) of 1 to 2 mm in diameter is inserted into the recess 13*d* through a gap of about 3 mm defined between the outer peripheral edge of the recess 13*d* and the plate fins 12 disposed in the recess 13*d*. A flowable, epoxy resin-based thermo-setting adhesive is quickly poured into the recess 13*d* through the adhesive pouring tube until a layer of adhesive 16 of a depth of from 2 to 5 mm is formed in the recess 13*d* so that at least one plate fin 12 in the recess 13*d* is embedded in the adhesive layer 16. A similar adhesive layer (not shown) is formed in a recess defined in the central zone of the lower header plate 18. Finally, the adhesive layers are cured by heating the heat exchanger assembly in a furnace at about 150° for about 20 minutes to complete the engine radiator 9 shown in FIG. 3.

When the radiator 9 is operatively connected to an internal combustion engine, hot engine cooling water flows from the engine through the inlet 14*b* into the upper tank 14. The water is then distributed from the upper tank 14 into respective tubes 11 through which the water flows downwardly into the lower tank 17. A cooling fan (not shown) is operated to direct cooling air to the radiator core 10 so that the cooling air flows through the core 10 in heat-exchange relationship to the hot water flowing through the tubes 11. Thus, the water is cooled during its passage through the tubes 11 and flows into the lower tank 17 from which the cooled water flows through the outlet 17*a* again into the engine.

The applicant conducted a Cass test in which Cass liquid (which includes 5% of NaCl, 0.26 g/liter of $CuCl_2$ and from 0.1 to 0.3% of $CH_3COOH$) was sprayed onto different radiators to hasten corrosion for thereby examining the corrosion-resistant properties of the radiators. The radiators tested had various lengths of exposed ends of tubes 11. The result of the test is shown in Table 1 below.

TABLE 1

| Length (B) of exposed tube ends | Duration until leakage from radiators took place (multiplied by $10^2$ hours) |
|---|---|
| 10 mm | 5 |
| 5 mm | 5 |
| 3 mm | 5 |
| 0 mm | 17 |

In the radiator 9 of the described embodiment of the invention, none of the tubes 11 has an exposed end because the collars 12*a* of the plate fins 12 and the adhesive layers 16 surround the entire length of each tube 11 to greatly improve the corrosion-resistant property of the radiator 9. In addition, the plate fins embedded in the adhesive layers not only relieve the curing stresses in the adhesive layers but also prevent the adhesive layers from being broken due to mechanical and thermal shocks, whereby the radiator 9 has an improved durability.

Figure 5:
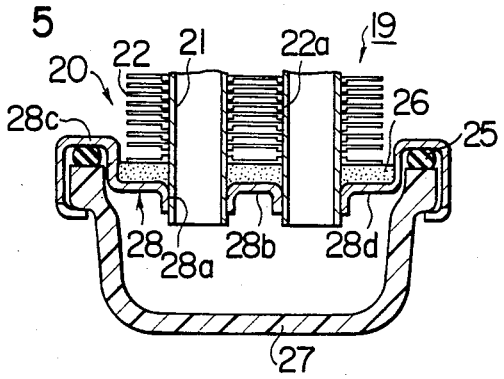
FIGS. 5 to 7 are similar to FIG. 4 but illustrate modified embodiments of the present invention.

FIG. 5 shows a part of a modified engine radiator embodying the present invention. The radiator 19 includes a heat exchanger core 20 formed by a plurality of tubes 21 and a stack or row of a plurality of plate fins 22 each formed therein with holes 22*a* into which the tubes 21 are inserted and secured to the fins 22. The tubes 21 have end portions extending from the core 20 and inserted into holes 28*a* formed in a depressed central zone 28*b* of a lower header plate 27 having an outer peripheral zone 28*c* mechanically secured to a lower tank 27 with an O-ring 25 interposed therebetween, as in the preceding embodiment. The lowermost plate fin 22 is inverted upside down with respect to the other plate fins. More specifically, the lowermost fin has an upwardly projecting collar whereas the other fins have downwardly projecting collars. The lowermost fin, therefore, presents a substantially planar bottom face. A layer of adhesive 26 is formed in a recess 28*d* defined by the depressed central zone 28*b* and an outer peripheral zone 28*c* of the header plate 28. The arrangement is such that the adhesive layer 26 is in face-to-face engagement with the lowermost fin 22 so that the adhesive layer is sandwiched between the header plate 28 and the lowermost fin 22 and mechanically supported thereby against forces, such as mechanical and thermal shocks and vibrations, which tend to separate the adhesive layer 26 from the tubes 21 and header plate 27. In addition, a major part of the upper surface of the adhesive layer 26 is covered with the lowermost fin 22 so that the sections of the adhesive layer 26 adjacent to the tubes 21 are reliably prevented from being deteriorated by foreign materials such as water and dirt.

The upper end of the heat exchanger core 20 is similarly mechanically and sealingly secured to an upper header plate (not shown) which in turn is mechanically and sealingly secured to an upper tank (not shown) as in the case of the connection between the lower tank 27 and the lower header plate 28.

Figure 6:
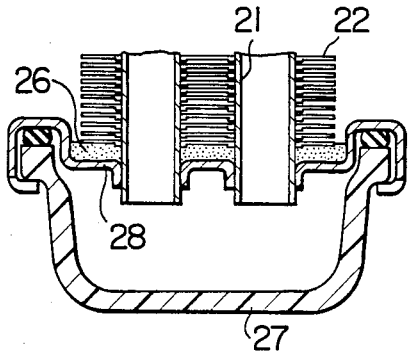
Figure 7:
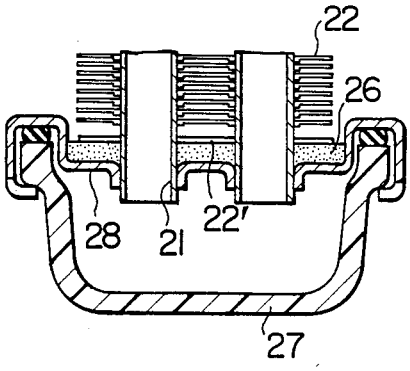

FIGS. 6 and 7 show modifications to the embodiment shown in FIG. 5. In the modification shown in FIG. 6, the lowermost fin 22 is not inverted upside down with respect to the other fins. Thus, the lowermost fin has its collar extending therefrom downwardly into engagement with the adhesive layer 26. In the modification shown in FIG. 7, the lowermost fin 22' does not have any collar and thus has a substantially planar bottom face which is in face-to-face engagement the adhesive layer 26.

In the described embodiments of the invention, plate fins 12 and 22 are mounted on and mechanically secured to the tubes 11 and 22 to form heat exchanger cores 10 and 20. This feature, however, is not essential to the present invention. Corrugated fins may alternatively be secured to the tubes by soldering. It will be noted therefore that the feature of the present invention can be applied to any types of heat exchangers which utilize adhesive layers which form liquid-tight seals between tubes and header plates. In addition, the present invention can be embodied not only in dow-flow type heat exchangers but also in horizontal-flow type ones.

What is claimed is:

1. A heat exchanger comprising a tank for momentarily storing a heat-transfer medium, said tank having a peripheral edge defining an opening, a header plate formed therein with a plurality of holes and sealingly secured to said peripheral edge of said tank to close said opening, a plurality of tubes each mechanically connected to one of said holes in said header plate so that said medium can flow through said tubes into and from said tank, said tubes and said header plate being in metal-to-metal gripping engagement with each other, a row of a plurality of fins disposed in heat-exchanging relationship to said tubes and extending substantially parallel to said header plate, and a layer of adhesive disposed on the surface of said header plate adjacent to said row of fins and forming a seal between said header plate and said tubes, said adhesive layer and said row of fins being arranged such that at least the fin which is nearest to said header plate is in engagement with said adhesive layer.

2. A heat exchanger according to claim 1, wherein at least said nearest fin is embedded in said adhesive layer.

3. A heat exchanger according to claim 1, wherein said nearest fin is in face-to-face engagement with said adhesive layer.

4. A heat exchanger according to claim 1, wherein said header plate includes an outer peripheral zone sealingly secured to said peripheral edge of said tank and a central zone in which said holes are formed, said central zone being offset from said outer peripheral zone inwardly into said tank to form a recess having a bottom, said adhesive layer being formed in said recess and in sealing contact with the bottom and inner peripheral surface of said recess and with a part of the length of each tube extending in said recess.

5. A heat exchanger according to claim 4, wherein at least said nearest fin is embedded in said adhesive layer.

6. A heat exchanger according to claim 4, wherein said nearest fin is in face-to-face engagement with said adhesive layer.

7. A heat exchanger according to claim 4, wherein said tubes and said fins are in metal-to-metal gripping engagement with each other.

8. A heat exchanger according to claim 7, wherein said header plate and each of said fins have collars.

9. A heat exchanger according to claim 4, wherein each of said fins is formed therein with holes through which said tubes extend, each hole in each fin having an inner peripheral edge with which an associated tube is in metal-to-metal gripping engagement to secure said tubes with said fins.

10. A heat exchanger according to claim 9, wherein said nearest fin is substantially planar and disposed in face-to-face engagement with said adhesive layer and each of the other fins has an integral collar axially extending from one of the surfaces of the fin in coaxial relationship to one of the holes in the fin, said collar surrounding an associated tube.

11. A heat exchanger according to claim 9, wherein each of said fins has an integral collar axially extending from one of the surfaces of the fin in coaxial relationship to one of the holes in the fin, said collar surrounding an associated tube.

12. A heat exchanger according to claim 11, wherein said nearest fin is arranged such that the collar of said nearest fin extends away from said adhesive layer so that said nearest fin has a substantially planar face disposed in face-to-face engagement with said adhesive layer.

13. A heat exchanger according to claim 11, wherein said nearest fin is arranged such that the collar of said nearest fin extends into engagement with said adhesive layer.

14. An automotive radiator comprising a heat exchanger including;

a core formed by a plurality of substantially parallel tubes and a row of a plurality of substantially parallel fins disposed in heat-exchanging relationship to said tubes;

each of said tubes having ends extending beyond the outermost fins of said row of fins;

a pair of tanks for momentarily storing a heat-transfer fluid;

each tank having a peripheral edge defining an opening;

a header plate formed therein with a plurality of holes and sealingly secured to the peripheral edge of each of said tanks;

each end of each tube being mechanically connected to one of the holes in one of said header plates; and a layer of adhesive disposed on each of said header plates and forming a seal between each header plate and said tubes;

at least the outermost fins of said row of fins being in engagement with the layers of adhesive on said header plates, respectively.

* * * * *